US009595373B2

(12) United States Patent
Hammond et al.

(10) Patent No.: US 9,595,373 B2
(45) Date of Patent: Mar. 14, 2017

(54) SHELF BRACKETS TO CONDUCT ELECTRICITY TO REFRIGERATOR SHELVES

(71) Applicant: WHIRLPOOL CORPORATION, Benton Harbor, MI (US)

(72) Inventors: Richard L. Hammond, Mattawan, MI (US); Michael Todd Moore, Paw Paw, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/007,392

(22) Filed: Jan. 27, 2016

(65) Prior Publication Data

US 2016/0141078 A1 May 19, 2016

Related U.S. Application Data

(63) Continuation of application No. 14/195,944, filed on Mar. 4, 2014, now Pat. No. 9,287,021.

(51) Int. Cl.

| | |
|---|---|
| ***F21V 33/00*** | (2006.01) |
| ***H01B 7/40*** | (2006.01) |
| ***F25D 27/00*** | (2006.01) |
| ***H01B 9/00*** | (2006.01) |
| ***F25D 23/06*** | (2006.01) |

(Continued)

(52) U.S. Cl.

CPC ..... *H01B 7/40* (2013.01); *F21V 33/0044* (2013.01); *F25D 23/062* (2013.01); *F25D 23/067* (2013.01); *F25D 25/02* (2013.01); *F25D 27/00* (2013.01); *H01B 9/006* (2013.01); *F21W 2131/305* (2013.01); *F25D 2201/00* (2013.01); *F25D 2327/00* (2013.01)

(58) Field of Classification Search

CPC H01B 7/40; H01B 9/006; F25D 27/00; F25D 23/062; F25D 23/067; F25D 25/02; F21V 33/0044; F21W 2131/305

See application file for complete search history.

(56) References Cited

U.S. PATENT DOCUMENTS

| | | | |
|---|---|---|---|
| 3,506,325 | A | 4/1970 | Horvay |
| 4,973,796 | A | 11/1990 | Dougherty et al. |
| 5,034,861 | A | 7/1991 | Sklenak et al. |

(Continued)

FOREIGN PATENT DOCUMENTS

| | | | |
|---|---|---|---|
| EP | 0558305 | A2 | 9/1993 |
| EP | 1222885 | A1 | 7/2002 |
| WO | 2007020470 | A1 | 2/2007 |

*Primary Examiner* — Thomas M Sember

(57) ABSTRACT

Shelf brackets to conduct electricity to refrigerator shelves are disclosed. An example shelf bracket includes an end configured to engage a support rail, the end having a first area to conduct electricity from the support rail to the shelf bracket, an arm extending from the end to support the shelf, the arm comprising a second area to conduct electricity from the shelf bracket to the shelf, a non-electrically conductive coating applied to substantially all of the shelf bracket except in the first and second areas, a first electrically conductive material applied to at least a portion of the first area, and a second electrically conductive material applied to at least a portion of the second area, wherein the shelf bracket is formed from a third electrically conductive material, the third electrically conductive material to conduct electricity between the first and second areas.

20 Claims, 5 Drawing Sheets

(51) Int. Cl.
*F25D 25/02* (2006.01)
*F21W 131/305* (2006.01)

(56) References Cited

U.S. PATENT DOCUMENTS

| | | | |
|---|---|---|---|
| 5,287,252 | A | 2/1994 | Caruso |
| 5,690,415 | A | 11/1997 | Krehl |
| 6,813,896 | B1 | 11/2004 | Janke et al. |
| 7,107,779 | B2 | 9/2006 | Avenwedde et al. |
| 7,338,180 | B2 | 3/2008 | Wing |
| 7,748,806 | B2 | 7/2010 | Egan |
| 7,840,286 | B2 | 11/2010 | Caldwell et al. |
| 8,135,482 | B2 | 3/2012 | Caldwell et al. |
| 8,136,956 | B2 | 3/2012 | Oketani |
| 8,360,802 | B2 | 1/2013 | Allard et al. |
| 8,453,476 | B2 | 6/2013 | Kendall et al. |
| 2008/0043456 | A1 | 2/2008 | Bernardini et al. |
| 2008/0092782 | A1 | 4/2008 | Daniel |
| 2008/0121146 | A1 | 5/2008 | Burns et al. |
| 2010/0006519 | A1 | 1/2010 | Vandesteen |
| 2010/0259148 | A1 | 10/2010 | Alberghetti et al. |
| 2011/0164399 | A1 | 7/2011 | Driver et al. |
| 2011/0203302 | A1 | 8/2011 | Alberghetti et al. |
| 2011/0204009 | A1 | 8/2011 | Karan |
| 2011/0273867 | A1 | 11/2011 | Horst et al. |
| 2013/0122739 | A1 | 5/2013 | Allard et al. |
| 2014/0376213 | A1 | 12/2014 | Miedema et al. |

SHELF BRACKETS TO CONDUCT ELECTRICITY TO REFRIGERATOR SHELVES

CROSS REFERENCE TO RELATED APPLICATIONS

This application represents a continuation of U.S. patent application Ser. No. 14/195,944, which was filed on Mar. 4, 2014 and titled "Shelf Brackets to Conduct Electricity to Refrigerator Shelves". The entire content of this application is incorporated by reference.

FIELD OF THE DISCLOSURE

This disclosure relates generally to refrigerator shelves, and, more particularly, to shelf brackets to conduct electricity to refrigerator shelves.

BACKGROUND

Most refrigerators have one or more shelves that facilitate the storage of items, such as food items. The shelves may be made of see-through materials such as glass and acrylic, or non-see-through materials.

SUMMARY

Shelf brackets to conduct electricity to refrigerator shelves are disclosed. An example shelf bracket includes an end configured to engage a support rail, the end having a first area to conduct electricity from the support rail to the shelf bracket, an arm extending from the end to support the shelf, the arm comprising a second area to conduct electricity from the shelf bracket to the shelf, a non-electrically conductive coating applied to substantially all of the shelf bracket except in the first and second areas, a first electrically conductive material applied to at least a portion of the first area, and a second electrically conductive material applied to at least a portion of the second area, wherein the shelf bracket is formed from a third electrically conductive material, the third electrically conductive material to conduct electricity between the first and second areas.

DETAILED DESCRIPTION

In some prior-art refrigerators, shelves are not lighted, which may impair a user's ease of seeing items stored in the refrigerators. In some prior-art refrigerators, lighting inside the refrigerator is mounted high in the refrigerators to provide general illumination within the refrigerators and, thus, may not adequately illuminate the area beneath shelves. To overcome at least these problems, shelf brackets that conduct electricity to shelves are disclosed. By conducting electricity to shelves, lighting units of the shelves can illuminate the area beneath the shelves.

Figure 1:
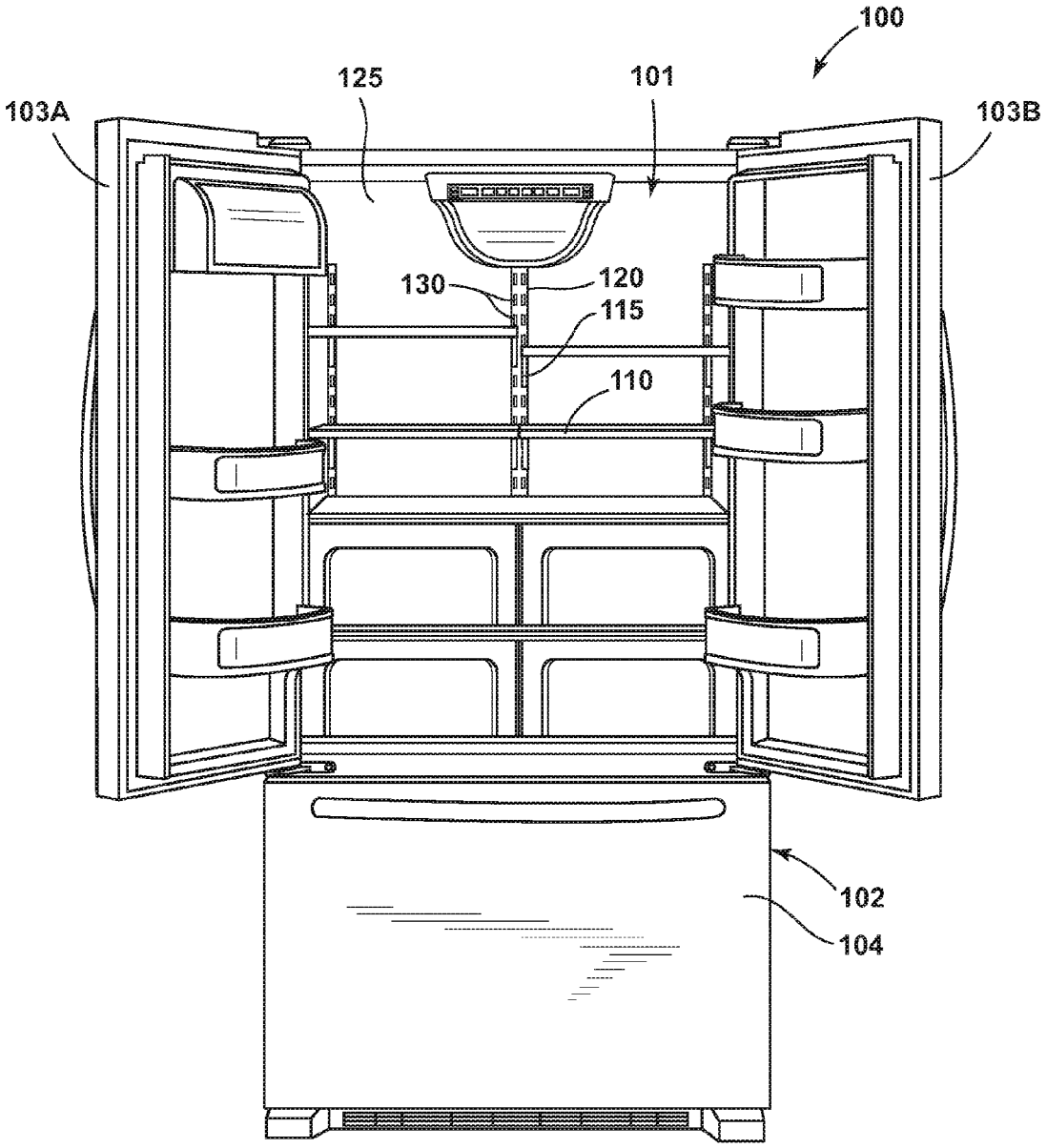
FIG. 1 illustrates an example refrigerator having a shelf bracket in accordance with the teachings of this disclosure.

FIG. 1 illustrates an example refrigerator 100 having a refrigerated compartment 101 and a freezer compartment 102. The refrigerated compartment 101 and the freezer compartment 102 each have an open face to provide access to the compartments 101 and 102. The refrigerator 100 includes doors 103A and 103B, and a drawer 104 moveably mounted to the refrigerator 100 for movement between opened and closed positions to selectively open and close the open faces of the compartments 101 and 102.

Although shelf brackets are disclosed herein with reference to the example refrigerator 100 of FIG. 1, one of ordinary skill in the art will readily appreciate that the shelf brackets disclosed herein may be used to conduct electricity to shelves in refrigerators having other configurations (e.g., a side-by-side refrigerators, a top-freezer refrigerators, etc.), in any other appliances including, but not limited to, a freezer, a washing machine, a dryer, a stove, a microwave, a dishwasher, a shelving unit, a refresher, etc., or in any other apparatus, device, installation, etc. having shelves to which conducting electricity is desired and/or needed.

To allow items to be stored in the refrigerator 100, the example refrigerator 100 of FIG. 1 includes one or more shelves (one of which is designated at reference numeral 110). To support and conduct electricity to the example shelves 110 of FIG. 1, the example refrigerator 100 includes a plurality of electrically conductive shelf brackets (one of which is designated at reference numeral 115) configured and constructed in accordance with the teachings of this disclosure. The example shelves 110 and shelf brackets 115 of FIG. 1 are moveably positionable within the refrigerator 100 to allow for the flexible storage of items in the refrigerator 100. In the example of FIG. 1, there are two shelf brackets 115 supporting each shelf 110, however, persons of ordinary skill of art will recognize that additional and/or alternative configurations may be used. Moreover, not all the shelf brackets 115 need be electrically conductive.

Figure 2:
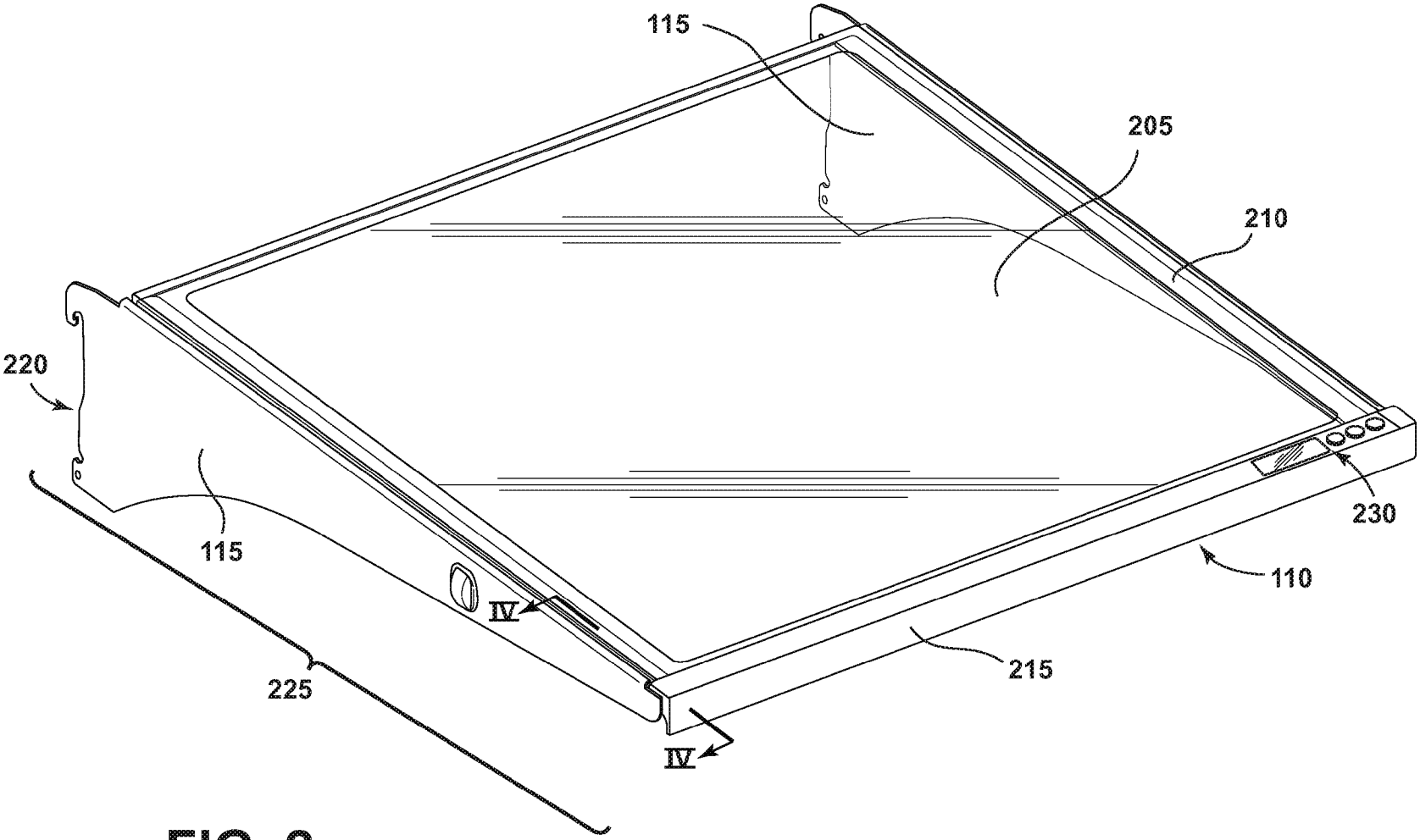
FIG. 2 is an isometric view of the example shelf of FIG. 1.

FIG. 2 is an isometric view of the example shelf 110 of FIG. 1 supported by a pair of the example shelf brackets 115. In the illustrated example of FIG. 2, the shelf 110 includes a piece of glass, acrylic, etc. 205 surrounded by a border 210, and trim 215 that runs along the front edge of the shelf 110. In some examples, the glass 205 is affixed to the bracket 115 by an adhesive 305 (see FIG. 3). As discussed below in connection with FIG. 4, a lighting unit 405 is positioned beneath the front edge of the shelf 110.

Returning to FIG. 1, to support the shelf brackets 115, the example refrigerator 100 includes a plurality of support rails or ladders (one of which is designated at reference numeral 120). The example rails 120 may be mechanically attached to a rear wall 125 of the refrigerator 100, or foamed into the rear wall 125 of the refrigerator 100. Ends of the shelf brackets 115 (one of which is designated at reference numeral 220 in FIG. 2) mechanically engage slots or openings (one of which is designated at reference numeral 130) in the rails 120.

Figure 3:
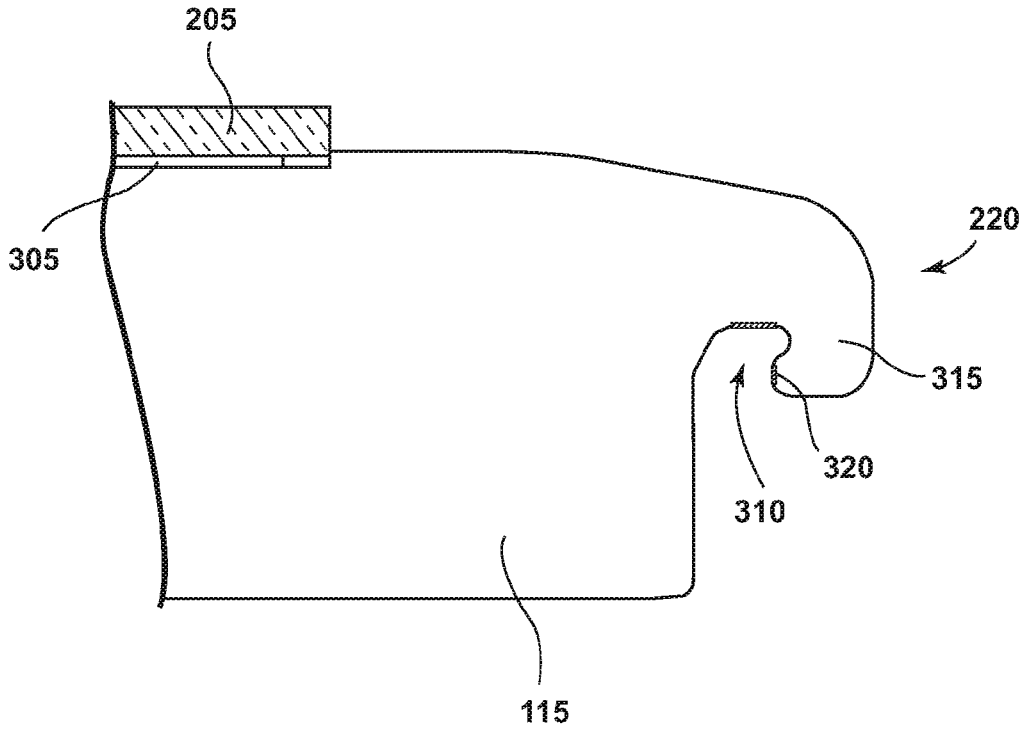
FIG. 3 illustrates an example end of the example shelf bracket of FIGS. 1 and 2.

For example, as shown in FIG. 3, the ends 220 of the example shelf brackets 115 may have a notch 310 and a tab 315. The example notch 310 of FIG. 3 engages an edge of an opening or slot 130 in the rail 120, and the example tab 315 engages a back side of the rail 120. Persons of ordinary skill in the art will readily appreciate that other openings or shelf bracket 115 ends 205 may additionally and/or alternatively used. As shown in FIG. 2, the shelf bracket 115 includes an arm 225 that extends forward from the end 220 and supports the shelf 110.

The example rails 120 of FIG. 1 are electrically energized so that electricity may be conducted to the shelf brackets 115. Electricity is conducted to the rails 120 via a terminal (not shown) foamed in the rear wall 125. In some examples, the rails 120 and the shelf brackets 115 conduct low voltage, low power electricity. In some examples, a controller (not shown) detects short conditions and stops the conveyance of electricity to the rails 120 for a pre-defined period of time after the short condition is detected. In the example of FIG. 1, substantially all exposed surfaces of the rails 120 are coated in a non-electrically conductive material or coating such as plastic, except at unexposed surfaces, areas or points that engage the shelf brackets 115, and conduct electricity to the shelf brackets 115. The unexposed surfaces, points or areas of the rails 120 may be masked before the non-electrically conductive material is applied. Additionally and/or alternatively, the non-electrically conductive material may be removed from these unexposed surfaces, areas or points after the non-electrically conductive material or coating is applied. These surfaces, areas or points may be left bare, and/or coated with an electrically conductive material or coating. In some examples, the rails 120 are formed of an electrically conductive material that resists corrosion, or these surfaces, points or areas are at least partially covered in an electrically conductive material that reduces corrosion of the rails 120.

To conduct electricity from the shelf brackets 115 to the shelves 110, the example shelf brackets 115 are formed of an electrically conductive material, such as steel, plated steel, a combination of nickel and tin, stainless steel, etc. Substantially all of the shelf brackets 115 are coated in a non-electrically conductive coating or material, such as a paint, a plastic, etc., except at surfaces, points or areas where electricity is intended to be conducted from the rails 120 to the shelf brackets 115, and at surfaces, points or areas where electricity is intended to be conducted from the shelf brackets 115 to the shelves 110 and/or lighting units 405 associated with the shelves 110. As shown in FIG. 3, an electrically conductive coating or material 320 may be applied to surfaces, points or areas where an end 220 of a shelf bracket 115 engages a respective rail 120. In some examples, the electrically conductive material from which the shelf brackets 115 are formed is masked at these surfaces, points or areas before the non-electrically conductive material or coating is applied. Additional and/or alternatively, the non-electrically conductive coating or material may be removed to expose these surfaces, areas or points. These surfaces, points or areas may be left bare, or at least partially covered in an electrically conductive coating or material. Example electrically conductive materials or coatings 320 include, but are not limited, an adhesive, a glue, a plastic, a nylon, a plating, etc. In some examples, the electrically conductive materials or coatings 320 are selected to reduce or substantially prevent corrosion of the shelf bracket 115. The electrically conductive material or coating applied at one end of the shelf bracket 115 may be different from the electrically conductive material or coating applied at an opposite end of the shelf bracket 115. Moreover, areas of the shelf bracket 115 may be left bare at one end while an electrically conductive material or coating applied to an opposite end.

When electricity is applied to the shelf bracket 115 by the rail 120, electricity passes through the shelf bracket 115 to the shelf 110. Accordingly, an electrical potential difference will form across the length of the arm 225 of the shelf bracket 115. Persons of ordinary skill in the art will readily understand that the electrical potential difference will depend, at least, on the voltage applied to the shelf bracket 115, the current demands of the shelf 110, and the electrical resistance of the shelf bracket 115.

Figure 4:
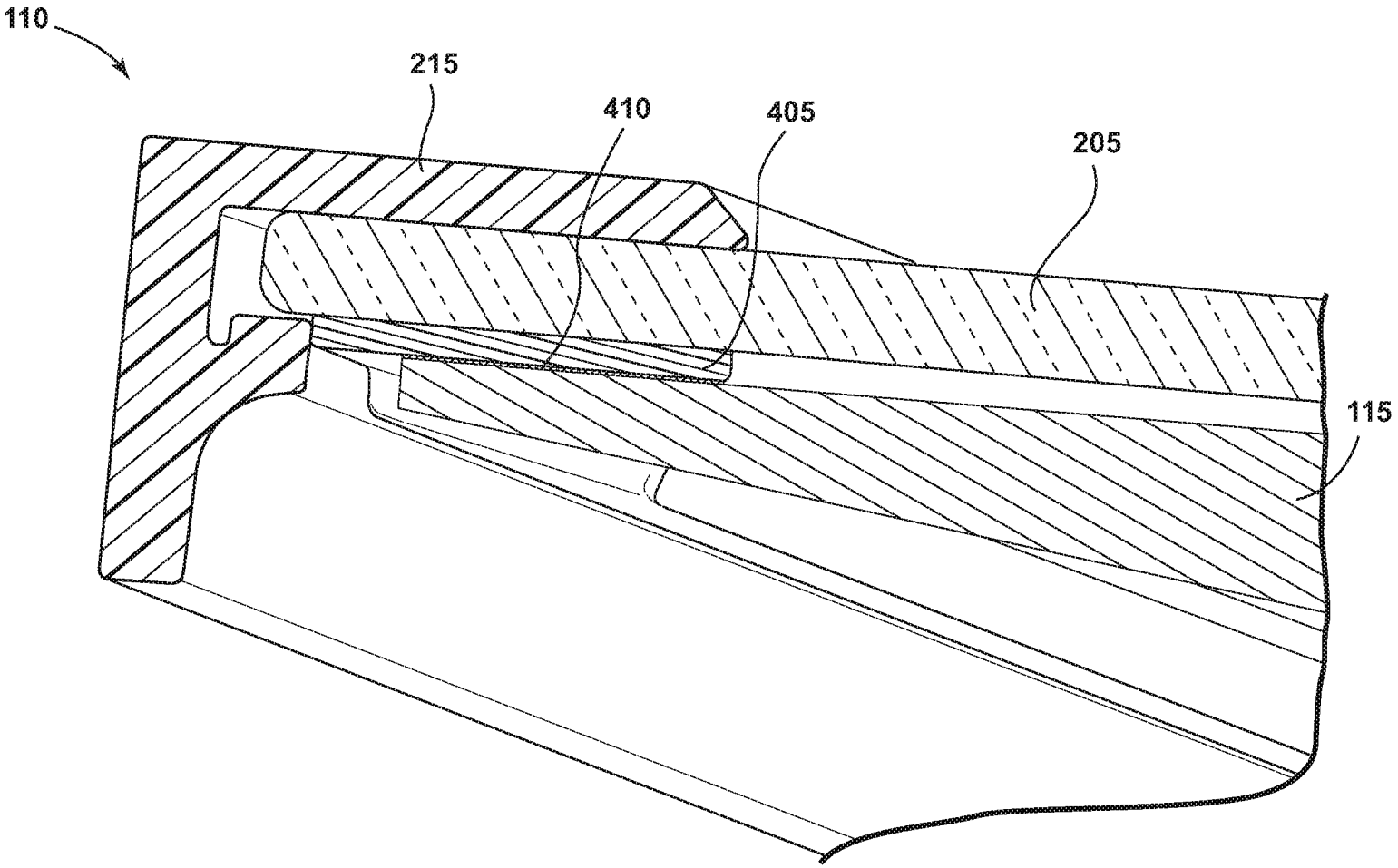
FIG. 4 is an isometric cross-section view of the example shelf bracket of FIGS. 1 and 2 taken along line IV-IV of FIG. 2.

To illuminate a shelf 110 and/or an area beneath the shelf 110, the example refrigerator 110 of FIG. 1 includes one or more lighting units 405 (FIG. 4) positioned within and/or beneath the shelf 110. In the example of FIG. 4, the lighting unit 405 is positioned beneath the shelf 110 along a front edge of the shelf 110, however, persons of ordinary skill of art will recognize that additional and/or alternative configurations may be used. As shown in the example of FIG. 4, the trim 215 overlaps the front edge of the glass 205. The lighting unit 405 is beneath the glass 205 and runs along the front edge of the shelf 110. The shelf bracket 115 conducts electricity to the lighting unit 405 via an electrically conductive material or coating 410 applied to the shelf bracket 115. The electrically conductive material from which the shelf bracket 115 is formed may be masked to define the area 410 before the non-electrically conductive material or coating is applied. Additionally and/or alternatively, the non-electrically conductive material may be removed from the area 410. The area 410 of the shelf bracket 115 may be left bare or may be covered in an electrically conductive coating or material. Example electrically conductive materials or coatings 410 include, but are not limited, an adhesive, a glue, a plastic, a nylon, a plating, etc. In some examples, the electrically conductive material or coating 410 is selected to reduce or substantially prevent corrosion of the shelf bracket 115. While one area 410 of electrically conductive material or coating in FIG. 4, one or more areas of electrically conductive material or coating may be used.

Figure 5A:
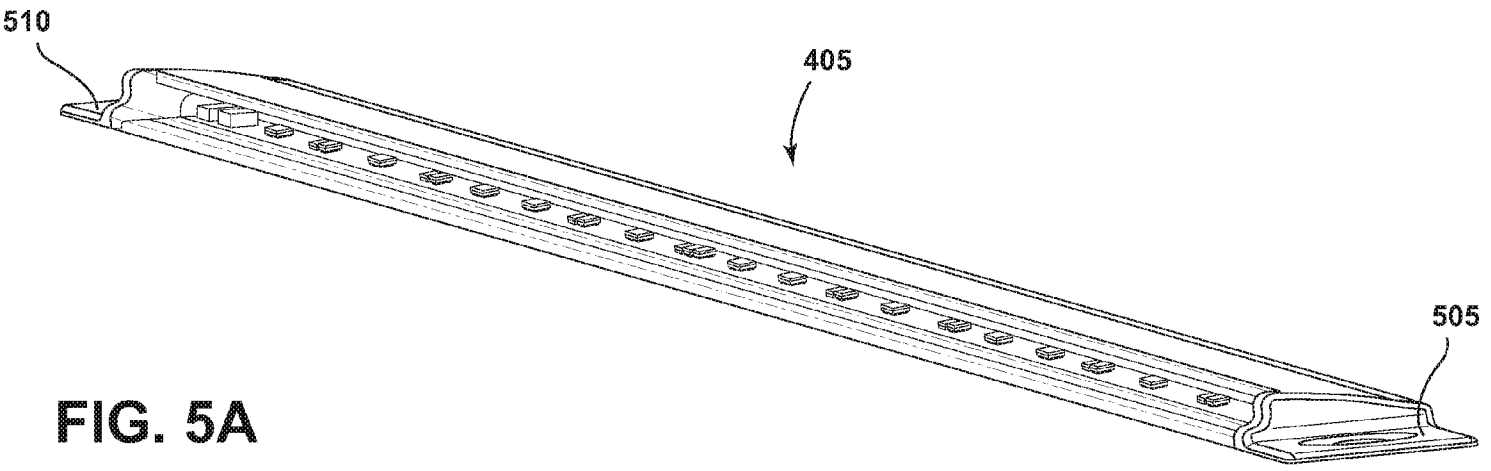
FIGS. 5A and 5B are isometric views of the example lighting unit of FIG. 4.
Figure 5B:
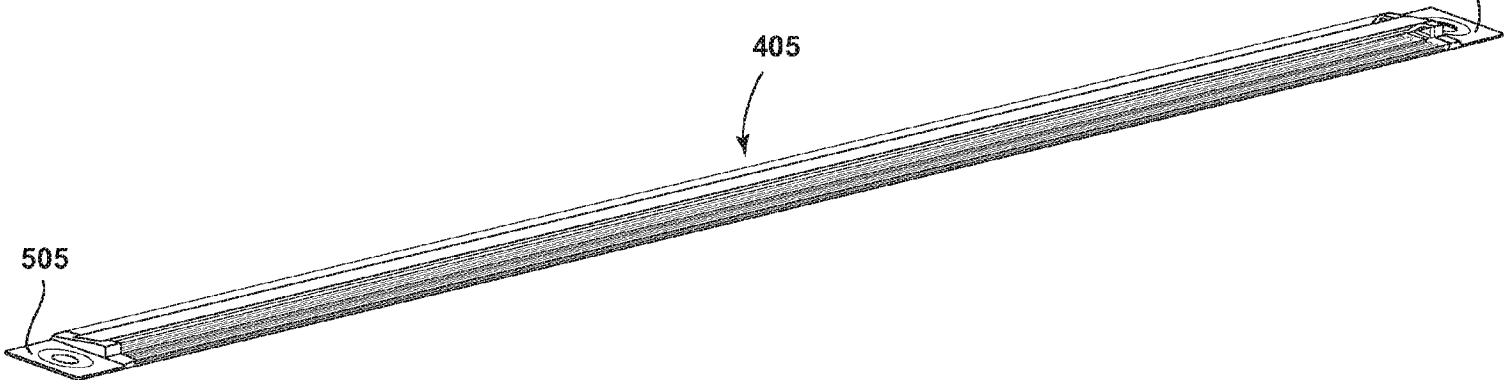

FIGS. 5A and 5B are isometric views of the example lighting unit 405. As shown in the example FIGS. 5A and 5B, the lighting unit 405 includes metallic tabs 505 and 510 to conduct electricity from the shelf bracket 115 to the lighting unit 405.

As shown in FIG. 2, the shelf 110 may additionally or alternatively include a user interface 230 that allows a user to control and/or adjust one or more parameters, variables, etc. that control and/or customize one or more operations of the refrigerator 100. For example, the user interface may be used to, for example, control a temperature, select a lighting color, a brightness, etc. The user interface 230 may include any number of buttons (e.g., capacitive touch points), displays, indicator lights, etc. The example shelf bracket 115 disclosed herein may be used to provide power to the user interface 230 in addition to or instead of the example lighting unit 405.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

The invention claimed is:

1. A refrigerator comprising:

a compartment;

a shelf;

a shelf bracket configured to support and conduct electricity to the shelf within the compartment of the refrigerator, the shelf bracket including:

a first area configured to engage a support rail and conduct electricity from the support rail to the shelf bracket, wherein the first area is part of an end of the shelf bracket, the end is configured to extend into an opening or slot defined in the support rail, and the first area is configured to engage an edge of the opening or slot;

a second area configured to conduct electricity from the shelf bracket to the shelf;

a third area configured to engage the support rail and conduct electricity from the support rail to the shelf bracket, wherein the third area is part of the end of the shelf bracket, and the third area is configured to engage a back side of the support rail; and a non-electrically conductive coating applied to substantially all of the shelf bracket except in the first, second and third areas, wherein the shelf bracket is formed from a first electrically conductive material and is configured to conduct electricity between the first and second areas.

2. The refrigerator of claim 1, further comprising:

an electrically conductive coating applied to at least a portion of at least one of the first and second areas.

3. The refrigerator of claim 1, further comprising:

a second electrically conductive material applied to at least a portion of at least one of the first and second areas.

4. The refrigerator of claim 3, wherein the second electrically conductive material comprises an adhesive, a plastic or a plating.

5. The refrigerator of claim 4, wherein the first electrically conductive material comprises a steel or a combination of nickel and tin.

6. The refrigerator of claim 3, wherein the second electrically conductive material is configured to reduce or prevent corrosion of the shelf bracket.

7. A shelf bracket configured to support and conduct electricity to a shelf of a refrigerator, the shelf bracket comprising:

a first area configured to engage a support rail and conduct electricity from the support rail to the shelf bracket, wherein the first area is part of an end of the shelf bracket, the end is configured to extend into an opening or slot defined in the support rail, and the first area is configured to engage an edge of the opening or slot;

a second area configured to conduct electricity from the shelf bracket to the shelf;

a third area configured to engage the support rail and conduct electricity from the support rail to the shelf bracket, wherein the third area is part of the end of the shelf bracket, and the third area is configured to engage a back side of the support rail; and a non-electrically conductive coating applied to substantially all of the shelf bracket except in the first, second and third areas, wherein the shelf bracket is formed from a first electrically conductive material and is configured to conduct electricity between the first and second areas.

8. The shelf bracket of claim 7, further comprising:

an electrically conductive coating applied to at least a portion of at least one of the first and second areas.

9. The shelf bracket of claim 7, further comprising:

a second electrically conductive material applied to at least a portion of at least one of the first and second areas.

10. The shelf bracket of claim 9, wherein:

the second electrically conductive material is applied to at least a portion of the first area;

a third electrically conductive material is applied to at least a portion of the second area; and the third electrically conductive material is different from the second electrically conductive material.

11. The shelf bracket of claim 9, wherein the second electrically conductive material comprises an adhesive, a plastic or a plating.

12. The shelf bracket of claim 11, wherein the first electrically conductive material comprises a steel or a combination of nickel and tin.

13. The shelf bracket of claim 9, wherein the second electrically conductive material is configured to reduce or prevent corrosion of the shelf bracket.

14. The shelf bracket of claim 7, wherein the non-electrically conductive coating is configured to reduce or prevent corrosion of the shelf bracket.

15. The shelf bracket of claim 7, wherein the non-electrically conductive coating comprises a plastic or a paint.

16. The shelf bracket of claim 7, wherein the second area is configured to conduct electricity from the shelf bracket to a lighting unit or a user interface of the shelf.

17. The shelf bracket of claim 7, further comprising:

an electrically conductive coating applied to at least a portion of at least one of the first and third areas.

18. The shelf bracket of claim 7, further comprising:

a second electrically conductive material applied to at least a portion of at least one of the first and third areas.

19. The shelf bracket of claim 18, wherein the second electrically conductive material comprises an adhesive, a plastic or a plating.

20. The shelf bracket of claim 18, wherein the second electrically conductive material is configured to reduce or prevent corrosion of the shelf bracket.

* * * * *